US008993827B2

(12) United States Patent
Soyfer et al.

(10) Patent No.: US 8,993,827 B2
(45) Date of Patent: Mar. 31, 2015

(54) METHOD FOR STABILIZATION AND REMOVAL OF RADIOACTIVE WASTE AND NON HAZARDOUS WASTE CONTAINED IN BURIED OBJECTS

(71) Applicant: VJ Technologies Inc., Bohemia, NY (US)

(72) Inventors: Boris Soyfer, Brooklyn, NY (US); Steve Halliwell, Warrenville, SC (US); Keith Stone, Carlsbad, NM (US)

(73) Assignee: VJ Technologies, Bohemia, NY (US)

( * ) Notice: Subject to any disclaimer, the term of this patent is extended or adjusted under 35 U.S.C. 154(b) by 73 days.

(21) Appl. No.: 13/694,305

(22) Filed: Nov. 16, 2012

(65) Prior Publication Data

US 2014/0142365 A1 May 22, 2014

(51) Int. Cl.

| | |
|---|---|
| ***G21F 1/00*** | (2006.01) |
| ***G21F 9/36*** | (2006.01) |
| ***G21F 9/30*** | (2006.01) |

(52) U.S. Cl.

CPC .. *G21F 9/30* (2013.01); *G21F 9/36* (2013.01); *Y10S 588/90* (2013.01)

USPC ..... 588/16; 588/250; 588/900

(58) Field of Classification Search

USPC ..... 588/2, 3, 4, 16, 17, 250, 259, 900

See application file for complete search history.

(56) References Cited

U.S. PATENT DOCUMENTS 6,062,813 A * 5/2000 Halliwell et al. ..... 415/174.5

* cited by examiner

*Primary Examiner* — Edward Johnson

(74) *Attorney, Agent, or Firm* — Kiran Malhotra

(57) ABSTRACT

A method and apparatus for the stabilization and safe removal of buried waste that is tested and classified as being transuranic or not transuranic waste and disposed accordingly. The buried waste (usually in vertical pipe units) is enclosed in a casing and ground and mixed with the surrounding soil. This process allows for chemical reactions to occur that stabilizes the mixture. The entire process is contained within the casing to avoid contamination. In situ or external testing is done for radio isotopes to classify the waste. If it is classified as transuranic the waste is removed in a controlled way into a retrieval enclosure and disposed off in drums. If the waste is not transuranic then grout is introduced into the mixture, allowed to set and the resulting monolith is removed and buried in trenches.

16 Claims, 9 Drawing Sheets

METHOD FOR STABILIZATION AND REMOVAL OF RADIOACTIVE WASTE AND NON HAZARDOUS WASTE CONTAINED IN BURIED OBJECTS

FEDERAL SPONSORED RESEARCH

Not Applicable

SEQUENCE LISTING OR PROGRAM

Not Applicable

BACKGROUND OF THE INVENTION

Radioactive waste has been buried in Vertical Pipe Units (VPU's) at various locations around the planet in many countries. The VPU's are hollow cylinders that are usually the length of five 55 gallon containers app. 15 feet long and 22 inches in diameter. In order to bury the VPU an excavation was prepared to the depth required and the VPU was set in the soil usually on a concrete footing or base. The VPU was then filled with smaller containers, such as vials and jars containing radio-active and non-radio active chemicals that may be liquid in nature. These VPU's are buried at known locations. The condition of the VPU's is unknown. Most of them were buried in the 1950's and corrosion could have damaged the steel walls of the VPU's. There is the present danger that after many years of burial the integrity of the VPU's is compromised such as these chemicals may leach out and contaminate the soil and get into the ground water. Presently an effective method to remediate and safely dispose of such waste does not exist. Remediation is the process of making a burial site non-toxic by the safe removal of the contents and back filling with fresh soil. Stabilization is the process of allowing the dangerous chemicals to react and mix with the soil thereby rendering them less dangerous to handle. In order to dispose of the waste buried in VPU's it is not safe to attempt to remove the buried VPU as a single unit because of the risk of leakage during removal. Furthermore, there is a need to have the capability of identifying the hazardous or non hazardous nature of the VPU contents because the method of disposal in each case will be different. The VPU contents get mixed with the surrounding soil. This process is completely contained within the enclosure provided by the apparatus used. The grinding of the VPU exposes the chemicals and allows chemical reactions to occur between the reactive chemicals stored in the VPU. This in-situ stabilization of contents makes it safer to remove and dispose. The chemical and soil mixture can be analyzed by various non destructive assay (NDA) methodologies and a continued determination made as to the hazardous nature of the mixed contents. This is determined by the measurement of radio activity to characterize the contents as to whether it is Transuranic (TRU) or not. U.S. Pat. No. 7,381,010 to Alexander et al 2008 Jun. 3 that showed a system and method of removal of buried objects did not resolve the stabilization and identification of the waste as shown in the embodiments described below. The aspects described below also addresses the in-situ stabilization of the hazardous contents that was not addressed by the Alexander patent.

The advantages listed below are for one or more aspects. The aspects discussed below efficiently render any VPU and its contents into a well mixed waste stream with no visible discrete objects (i.e anomalies) in a manner that is safe for workers; safe for the environment, meets applicable environmental regulations and does not expose identifiable waste objects to the atmosphere. Furthermore, the waste is efficiently removed from the waste site. It is characterized with respect to transuranic (TRU) isotope concentration. Waste is characterized with respect to waste acceptance criteria. Specially designated waste disposal facilities exist in the USA for TRU waste and non TRU waste.

Thus several advantages of one or more aspects are that the containers are punctured and the waste mixed with the soil. This technique allows the chemicals contained in the waste to react with each other thereby reducing the reactivity of the chemicals. The waste is mixed with the soil and in one or more aspects in situ measurement of radiation is done to characterize the waste in terms of its radioactivity. This process of grinding of the contents of the VPU with the soil leads to stabilization of the waste. A NDA is conducted in-situ to categorize the radioactivity of the waste. Optical inspection of the waste in one aspect provides a visual record of the stabilized waste prior to disposal. The aspects also show the system and safe removal of the waste/soil mixture depending on the category of the mixture based on its radioactive level without danger of emission or leakage into the environment. The mixing with the soil allows the liquids to be absorbed and the waste will not have free liquids that are prohibited to be present in the waste regardless of whether they are radioactive or non hazardous liquids. These and other advantages of one or more aspects will become apparent from consideration of the ensuing description and accompanying drawings.

BRIEF SUMMARY OF THE INVENTION

The aspects describe a system and method for the stabilization and safe removal of the contents of buried VPU's that contain TRU as well as non TRU waste. In one aspect a crane with a vibratory hammer is used to lift and insert a four foot diameter; ½ inch thick carbon steel spiral 25 feet in length casing over the buried VPU. An enclosure base (EB) is used to align the casing over the VPU. The vibratory hammer sinks the casing to a depth of approximately 22 feet and the over-casing extends approximately 5 feet below the bottom of the VPU providing an enclosure that surrounds the buried VPU.

The next stage of the process is to introduce a grinding tool such as an auger to grind and shred the contents in order to reduce the size of the contents and mix intimately with the surrounding soil. The apparatus used has sealing parts to ensure that no dust escapes outside the over casing or into the atmosphere during the grinding process. The contents of the VPU are ground to reduce the size to approximately 0.5 inches in to around 3.0 inches dimensions in random particle shapes that get mixed with the surrounding soil. This mixing process exposes the chemicals that are stored in the VPU and allows reactions to occur. The main concern is for sodium potassium (NaK) and/or its super oxides that were used in nuclear reactors as a cooling medium. The breaking of the containers stored in the VPU will release chemicals and free liquids for reactions to occur. These chemicals react violently with each other in the presence of oxygen or water and are rendered less harmful. Furthermore, free liquids will mix with the soil and get absorbed. The VPU contents get mixed with the surrounding soil. This process is completely contained within the casing provided by the system used. The chemical and soil mixture is analyzed by non destructive assay (NDA) methodologies the radioactivity level of the mixed materials is determined and the waste is characterized as being TRU waste or non TRU waste. The threshold of radio activity for this determination is 100 nanocuries (nCi)/gm. If it is determined that the mixture is not TRU then one or more retrieval and disposal methods related to non hazardous material is used. If it is determined that the mixture is TRU waste then a different method for retrieval and disposal is used. In situ NDA methods are shown in the different aspects The NDA can also be conducted in an outside laboratory if required.

Based on the radioactivity level different techniques are used. TRU waste is retrieved without further treatment using methods that prevent any leakage. In one aspect a retrieval enclosure (RE) is used. A video record of the waste stream is made in one aspect prior to packing in new 55 gallon drums. For non TRU waste grout is introduced and the waste mixed with the grout. This grout is allowed to set such that a monolith is formed. This VPU monolith is removed and placed in a previously dug trench for safe removal.

For TRU waste in one aspect a retrieval bucket is used to retrieve the stabilized contents. A video recording may be made of the mixture contents prior to storage of the contents in new 55 gallon drums for safe disposal. A second aspect introduces a grouting mixture via a grouting tool that replaces the auger such that a fixative type grout can be introduced through the grouting tool into the waste/soil mixture. The fixative grout is commercially available and well known in the art. It reduces the formation of dust by wetting the contents and the waste can be removed without creating hazardous dust. Non TRU waste can similarly be mixed with a standard setting type grout. This grout is allowed to cure such that a monolith or column of the contents and grout is created and the entire column can be removed and disposed off in trenches. The various embodiments and aspects in the summary are described in detail in the following description along with the drawings listed below.

DRAWINGS

Figures

Figure 5A:
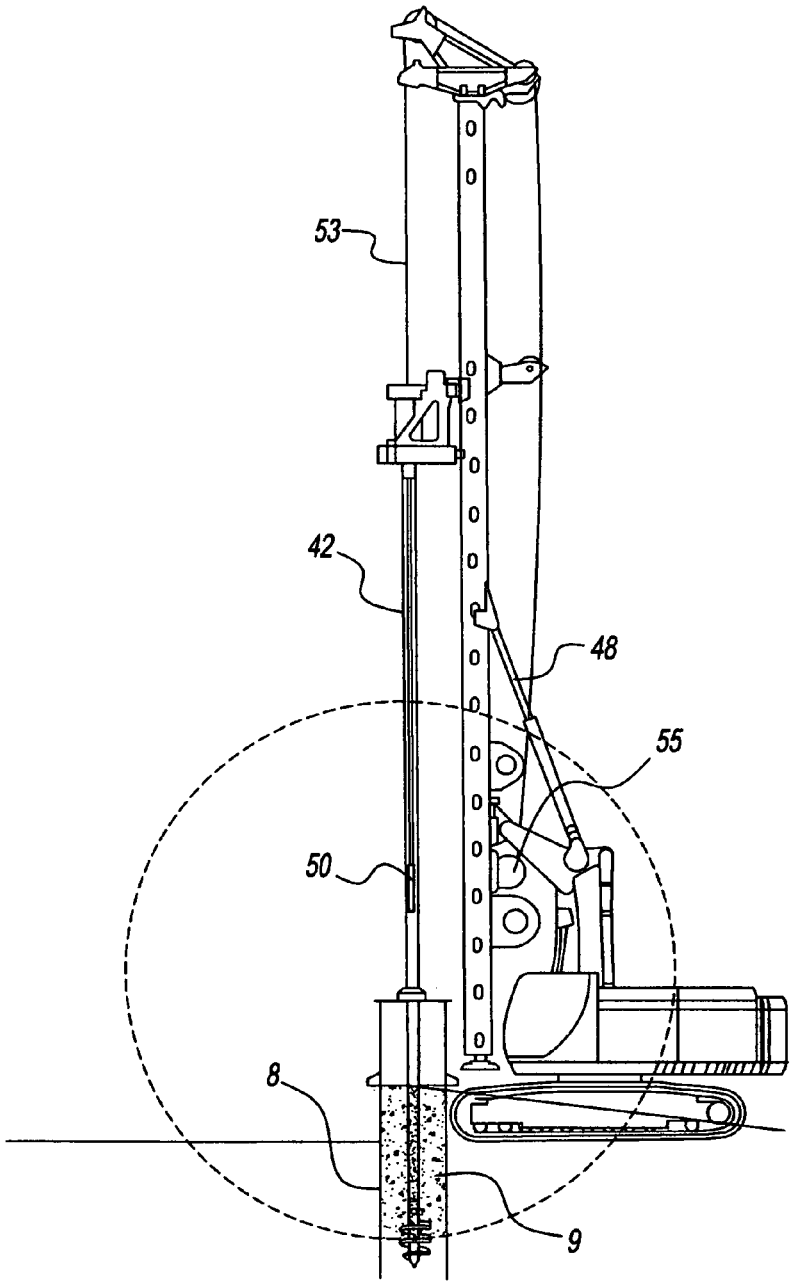
Figure 5B:
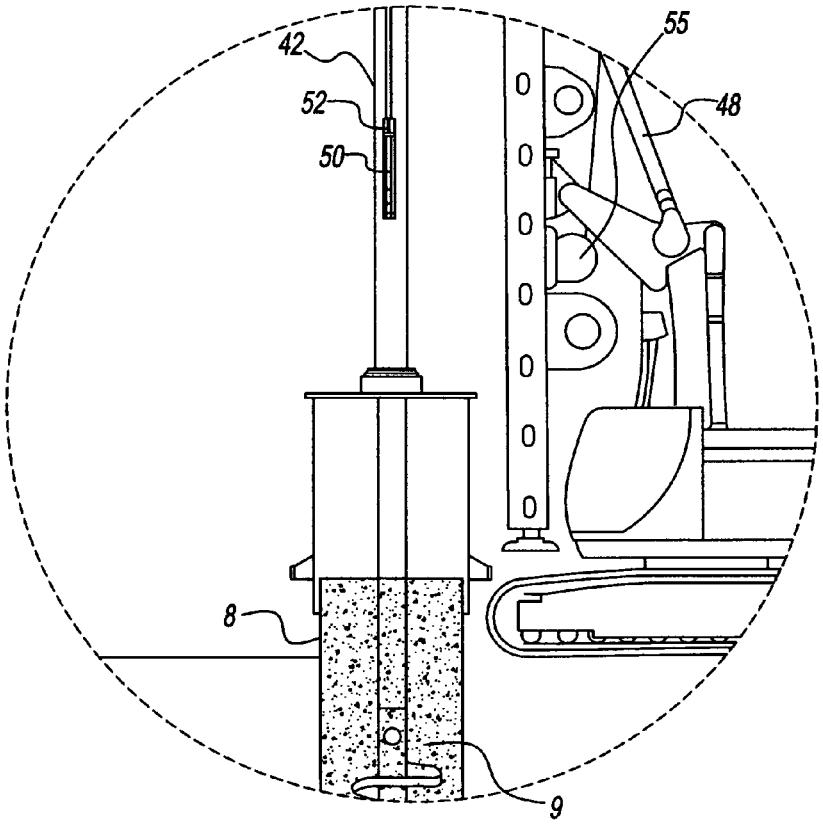

FIG. 5*a* shows a sectional view of the HSA supported by the drilling rig containing the gamma and neutron detector. FIG. 5*b* is an exploded view of a section of FIG. 5*a* showing the gamma and neutron detector in its protective casing.

Figure 6:
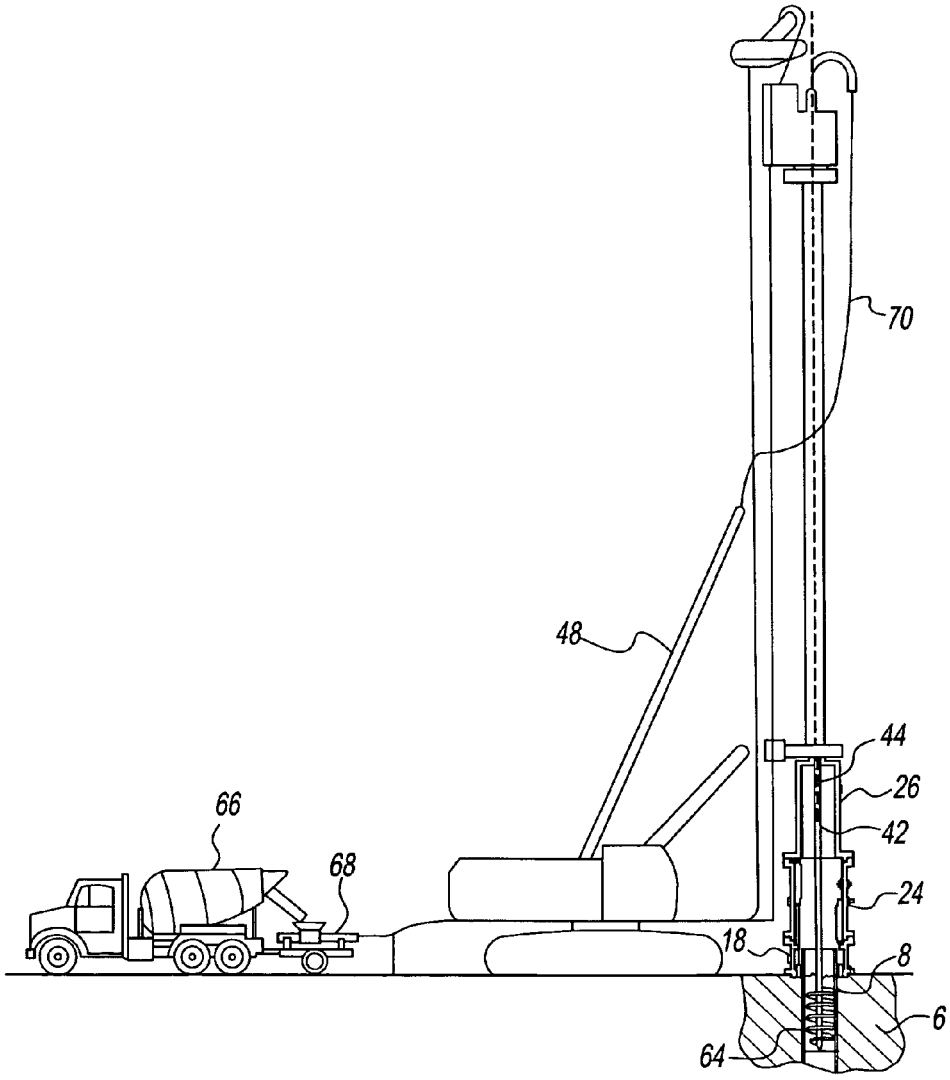

FIG. 6 shows a system for grout delivery to the HSA.

Figure 7:
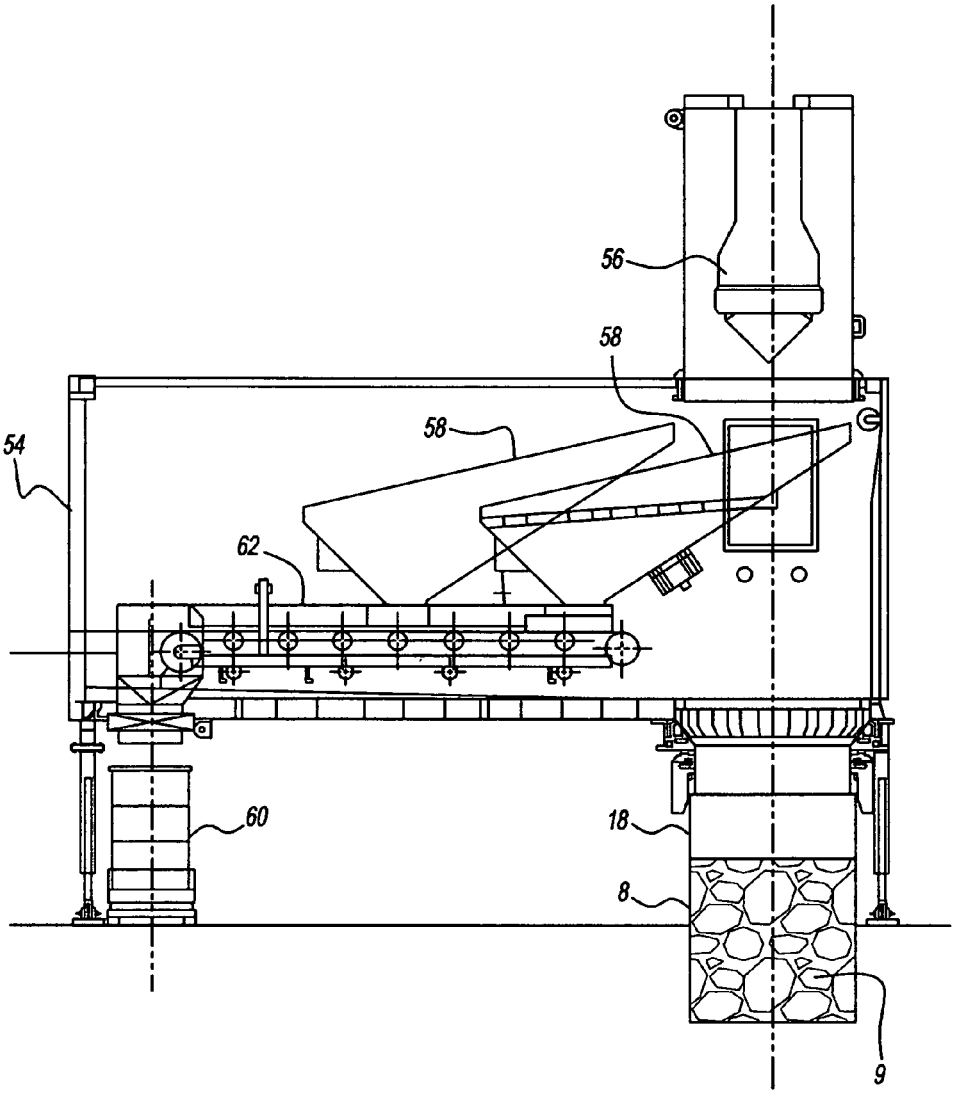

FIG. 7 shows a sectional view of the retrieval enclosure containing the retrieval bucket and the waste disposal system containing the hopper and the conveyor belt.

Figure 8:
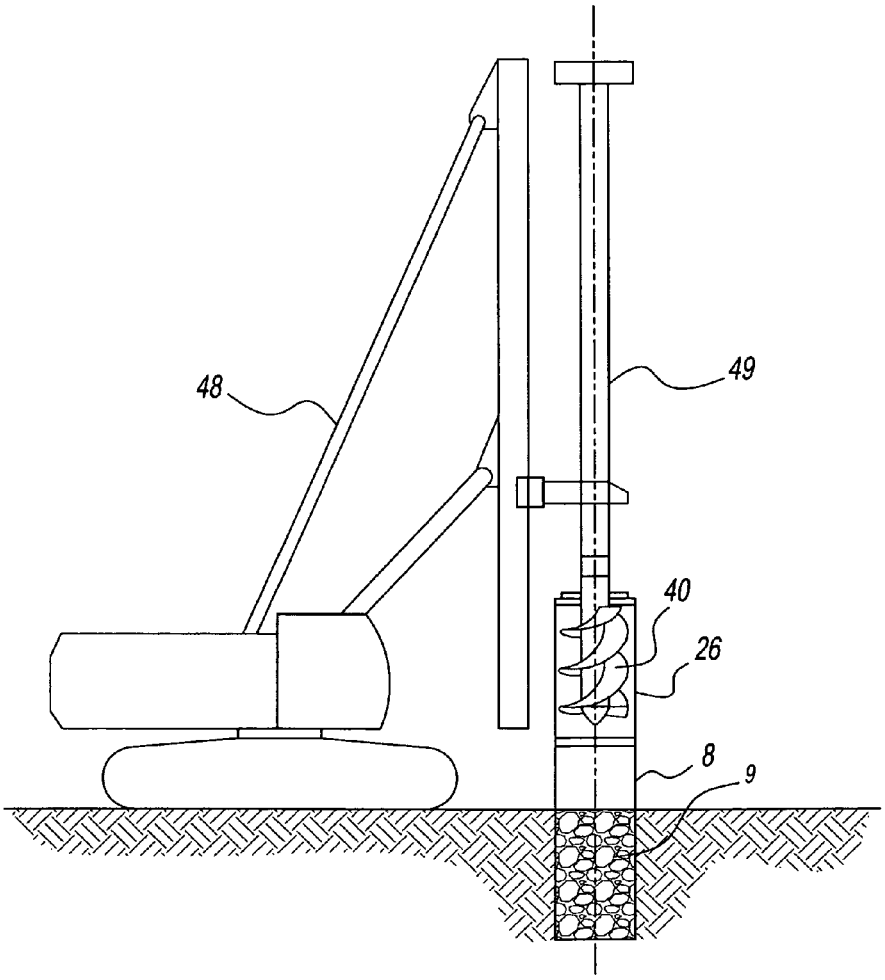

FIG. 8 shows a sectional view of the augering tool in the ATE attached to the drilling rig. The IE and EB are not separately shown in this figure and are shown incorporated into the ATE that is placed on top of the casing. The augering tool is shown in its position after the VPU and contents have been ground and mixed with the soil.

REFERENCE NUMERALS

In the drawings identical reference numerals denote the same elements throughout the various views.

6 Soil
8 Casing
9 Stabilized mixture
10 Vertical Pipe Unit (VPU)
18 Enclosure Base (EB)
20 Alignment pins
24 Interface Enclosure (IE)
26 Auger Tool Enclosure (ATE)
28 Tool Enclosure door
30 Air sampling port
34 Safety shut down door
36 Seals
38 Attachment for high pressure water
39 Attachment for low pressure water
40 Augering tool
42 Hollow Stem Auger (HSA)
44 Hollow Stem
46 Sampling port
48 Drilling rig
49 Kelly Bar
50 Detector
52 Metal Tube
54 Retrieval Enclosure (RE)
56 Retrieval Bucket
58 Retrieval Hopper
60 Conveyor belt
62 55 gallon drums
64 Grout mixture
66 Cement Truck
68 Pump
70 Hose

GLOSSARY

Transuranic waste (TRU) is, as stated by U.S. regulations and independent of state or origin, waste which has been contaminated with alpha emitting transuranic radionuclides possessing half-lives greater than 20 years and in concentrations greater than 100 nano curies (nCi)/gram (3.7 MBq/kg). Elements having atomic numbers greater than that of uranium are called transuranic. It is material that is contaminated with U-233 (and its daughter products), certain isotopes of plutonium, and nuclides with atomic numbers greater than 92 (uranium). It is produced during reprocessing of spent fuel to separate plutonium for use in weapons. These man made elements within TRU are known to contain americium-241 and several isotopes of plutonium. Their radioactivity is generally low, but since they contain several long-lived isotopes, they must be managed separately. Because of the elements' longer half-lives, TRU is disposed of more cautiously than non TRU waste. In the U.S. it is a byproduct of weapons production, nuclear research and power production, and consists of protective gear, tools, residue, debris and other items contaminated with small amounts of radioactive elements (mainly plutonium).

The curie (symbol Ci) is a unit of radioactivity named after Marie and Pierre Curie. It is defined as 1 Ci=$3.7\times10^{10}$ decays per second. One Curie is roughly the activity of 1 gram of the radium isotope $^{226}$Ra, a substance studied by the Curies. The SI derived unit of radioactivity is the becquerel (Bq), which equates to one decay per second. Therefore: 1 Ci=$3.7\times10^{10}$ Bq=37 GBq. One nano curie is one billionth of one Curie.

Nuclear regulatory Commission (NRC) regulatory Guidelines 8.21 and 8.23 define removable surface activity as "radioactivity that can be transferred from a surface to a smear test paper by rubbing with moderate pressure."

DETAILED DESCRIPTION

Figure 1:
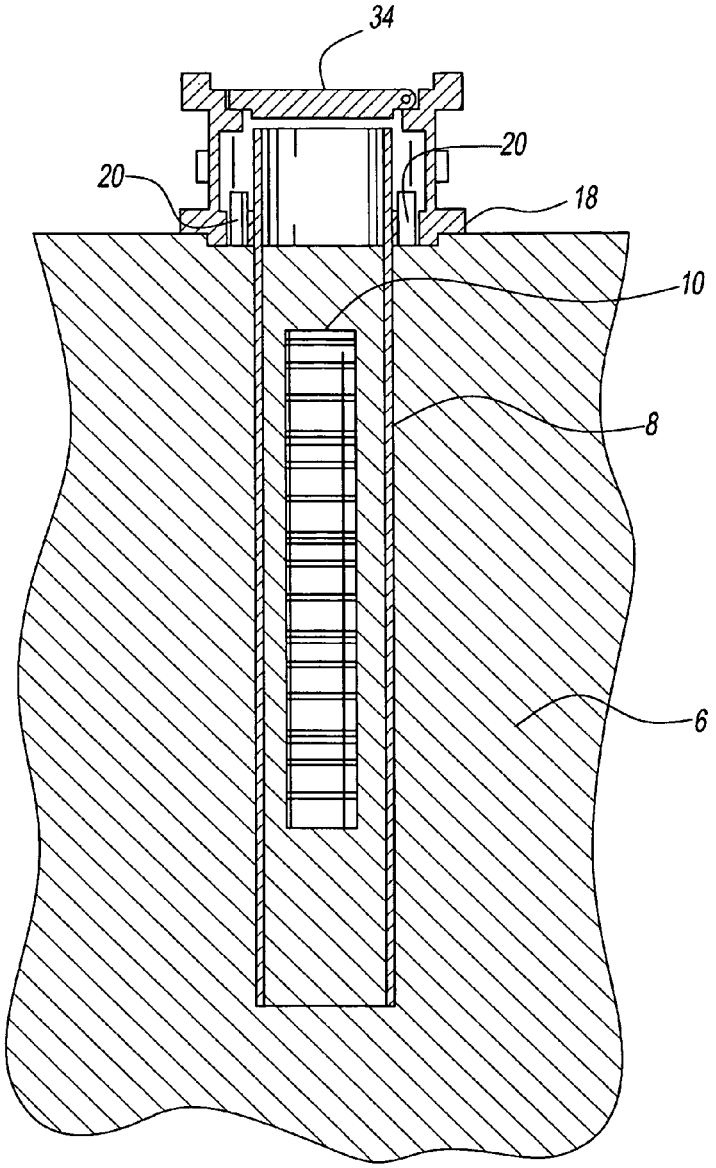
FIG. 1 shows a sectional view of a buried 5 drum VPU surrounded by the casing and enclosure base over the casing.

FIG. 1 shows the aspect where the casing (8) surrounds the buried VPU (10). The casing is made of ½' thick carbon steel spirally welded metal pipe about 25 feet in length. The 25 feet length of the casing (8) results in approximately 3 feet remaining over ground level and 22 feet below the ground level to a depth of approximately 5 feet below the bottom of the VPU. The casing (8) is 4 feet in diameter. Alignment pins (20) on an enclosure base (EB) (18) are used to center the casing (8) around the VPU. It can be recognized that the EB (18) can be replaced by attachments on the steel casing that can be used for the purpose of centering and a separate enclosure base may not be necessary.

Figure 2:
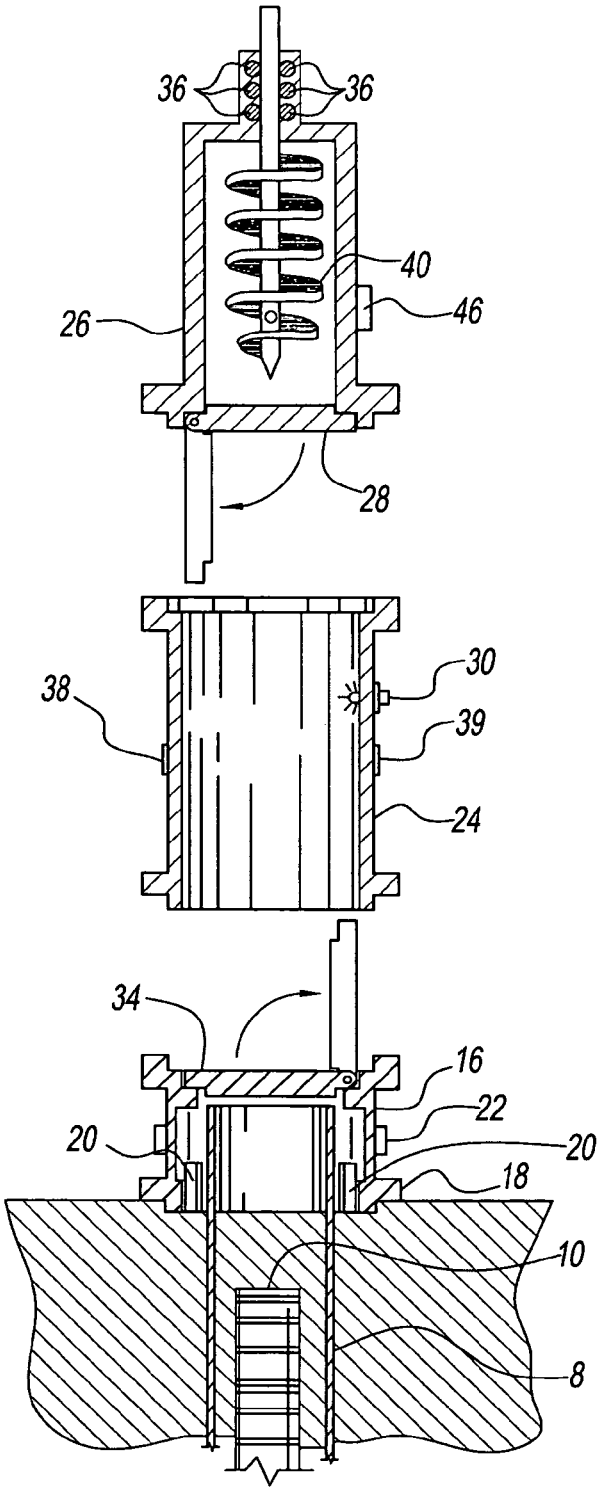
FIG. 2 shows a sectional view of the enclosure base (EB); interface enclosure (IE) and auger tool enclosure (ATE).
Figure 3:
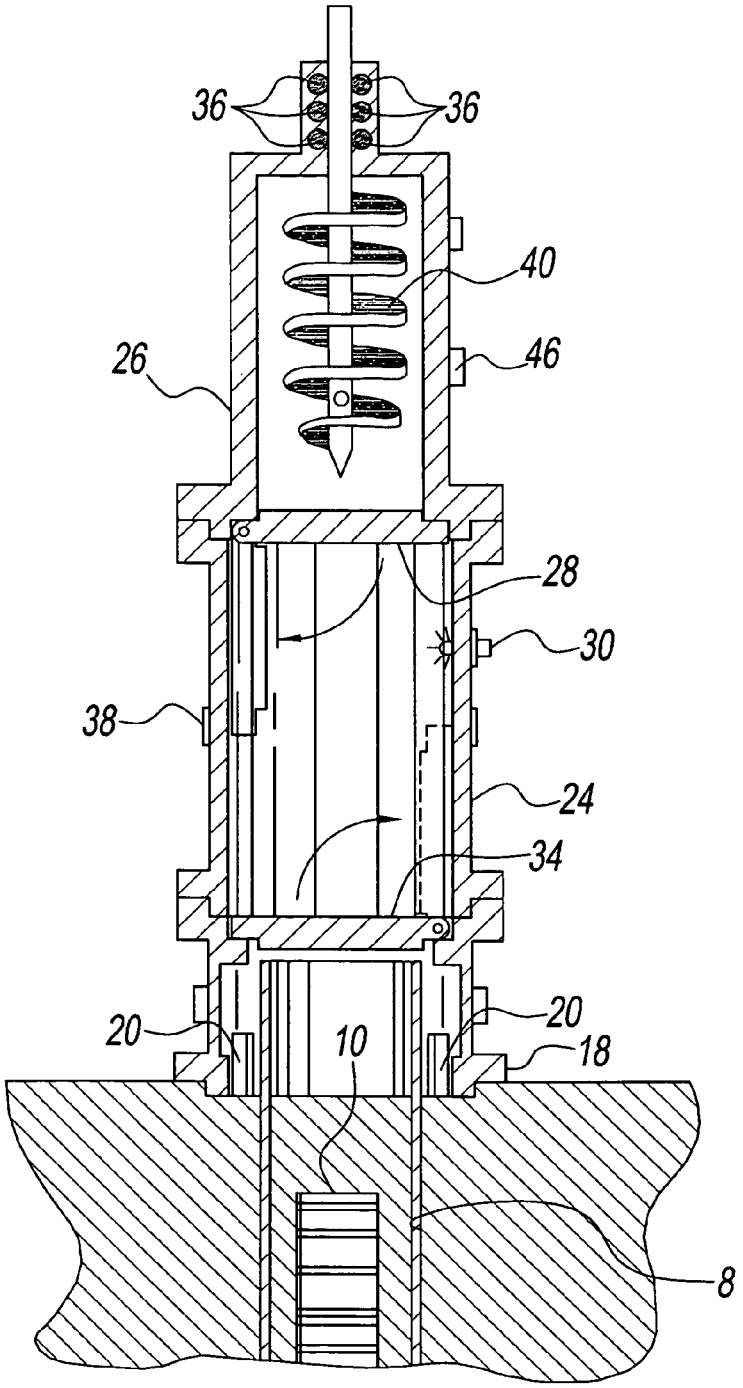
FIG. 3 shows a sectional assembled view of the EB; IE and ATE.

FIG. 2 shows the exploded view of the enclosure assembly consisting of three sub-assemblies. The EB (18) has a plurality of the alignment pins spaced on the base to help align the casing (8) concentrically over the buried VPU (10). The EB (18) is equipped with a safety shutdown door (34). An interface enclosure (IE) (24) is placed and secured over the EB (18) and provides dust control during augering. The IF (24) has an air sampling port (30) for taking air samples for analysis of gases. All the air is exhausted through a passive high efficiency particulate (HEPA) filter (not shown) and into the atmosphere. The HEPA filter technology is well known in the art. Alternate methods know in the art can be used to ensure that the discharged air is environmentally safe. The IE (24) has attachment ports for high pressure, low volume water (38) to clean the augering tool (40) as it is being retracted. (Mechanical devices such as scrapers can also be used for this purpose). It also has attachment ports (39) for low pressure, low volume dust suppression system (Dust Bond™, calcium chloride solution) that is used to reduce dust during augering. The IE (24) is the attachment point for the an augering tool enclosure (ATE) (29) containing the augering tool (40) or a hollow stem auger (HSA) (42) (FIG. 4) that has a hollow stem in the axial direction. (44). (As will be seen later two augering tool enclosures are provided, one housing the augering tool and the other housing the hollow stem auger). The ATE (26) has a tool enclosure door (28). This door is kept closed for safe removal of the ATE (26) containing the augering tool (40). The ATE (26) is provided with a sampling port (46) for testing surface contamination on the augering tool (40) using the "smear test" that is well known in the art. Seals (36) seal the augering tool shaft and the rotational shaft also known as the Kelly bar (49) to prevent any contaminated air or dust escaping into the atmosphere. It is possible to provide one single unit (52) that combines the features of the IE (24) and ATE (26). It can be provided with the same features for cleaning, sampling and clean venting through the HEPA filters as is provided with having three separate units.

The drilling rig (48) attaches its rotational shaft also known as a Kelly bar (49) to the auger shaft protruding through the top of the ATE. (FIG. 8). The drilling rig is used to move the ATE (26) containing the augering tool (40) into position over the IE (24) and is attached to it using conventional attachment methods. The augering tool (40) has a diameter of app. 46 inches to provide a small clearance as it is inserted into the casing. By its rotation it punctures the VPU (10) wall, grinds the contents of the VPU (10) and mixes it with the surrounding soil (6). The stabilized mixture (9) shown in FIGS. 7 and 8 is tested and retrieved using methods shown in the Operation section below. The retrieval method is dependent on whether the stabilized mixture (9) tests as TRU or non TRU waste.

Figure 4:
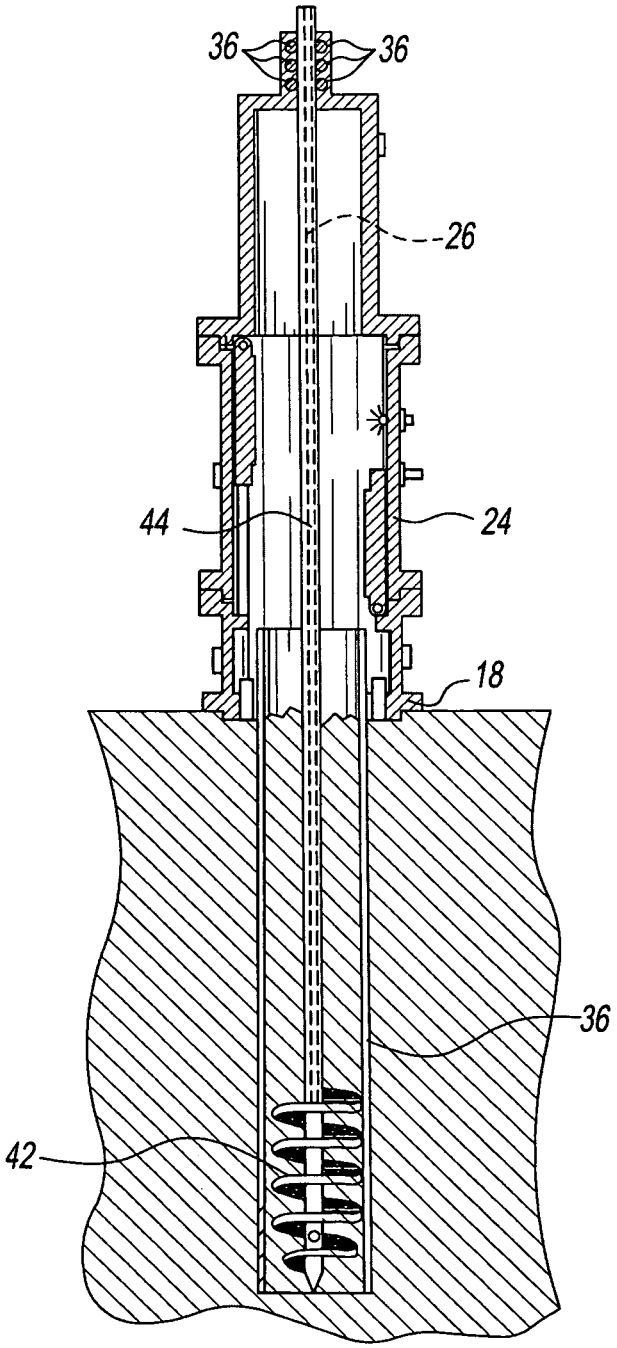
FIG. 4 shows a sectional assembled view of the EB; IE and ATE containing a hollow stem auger (HSA).

FIG. 4 shows the sectional view of the HSA (42) that serves a dual purpose in the system. It is used as a grouting tool to insert grout and create a monolith for the removal of certain types of waste such as non TRU waste. The HSA (42) is also use to introduce a fixative grout to reduce dust in case of TRU waste. It is also used in one aspect for introducing a radio active measuring device as shown in FIG. 5 for in-situ non destructive assay (NDA) of the ground mixture The HSA (42) has a diameter of approximately 14 inches and an cylindrical stem diameter of approximately 4 to 6 inches. The HSA (42) is housed in a second ATE (26) identical to the one that is used for the augering tool (40) so that it can be used interchangeably to attach to the IE (24) unit.

FIG. 5*a* shows the detector (50) inside the HSA (42) and the cable (53) attached to a pulley mechanism (55) that is used to insert and raise the detector (50) in-situ for a non destructive assay (NDA) in one aspect of the invention. Any other mechanical device can be used for this purpose. FIG. 5*b* shows the detector (52) housed in a steel tube (52) of appropriate diameter for protection or it may be inserted directly into the HSA without a tube covering it. The detector measures gamma and neutron radiation levels emitted by the contents of the VPU after grinding. The NDA instrumentation can also provide isotopic information of the radioactive materials that are present. The detector sends a signal that can be remotely monitored by an operator. Instead of this in-situ measurement it is possible to insert soil sampling devices into the HSA (42), remove samples and test a sample of the stabilized mixture (9) in the RE (54) or in an off-site laboratory.

FIG. 6 shows the cement truck (66), and the pump (68) that is used to pump the grout mixture to the HSA (42) through the Hollow Stem (44).

FIG. 7 shows the sectional view of the retrieval enclosure (RE) (54) and retrieval bucket (56) The RE (54) is attached to the EB (18) for retrieval after the grinding and the NDA operations are completed. The IE (24) and the ATE (26) are removed prior to attachment of the RE (54). The retrieval bucket (56) is approximately 30 gallons in volume and is used to scoop the stabilized contents from within the casing (8). The retrieval bucket is connected to shafts that can extend the complete length of the casing (8) to completely remove the stabilized contents. Full buckets are held in position near the top of the RE while a lateral moving retrieval hopper (58) is brought into position below the bucket by conventional mechanical devices. Two positions of retrieval hopper are shown in FIG. 7. Other means of removal such as screw conveyor; clam shell and pneumatic devices can be used instead of the retrieval bucket. CCTV cameras (not shown) may be attached to the interior walls of the RE. HEPA filters (not shown) are attached to the walls for removal of all particulates from escaping air. The cameras take a video of the contents as they are dumped on the conveyor belt (62) and ultimately into the receiving drum (60).

FIG. 8 shows a sectional view of the augering tool in the ATE (26) attached to the drilling rig (48). The IE and EB are not separately shown in this figure and are shown incorporated into the ATE (26) that is placed on top of the casing (8). The augering tool (40) is shown in its position after the VPU and contents have been ground and mixed with the soil. (9). As explained in the Conclusions; Ramifications and Scope section below the ATE, IE and EB units can be combined into one unit in another aspect of the invention as shown in FIG. 8.

Operation

The process begins with establishing the target or location for surrounding the VPU with the casing (8). The enclosure base (EB) (18) is installed over the VPU centerline with the help of the alignment pins (20). Following this casing (8) is driven into the soil surrounding the buried VPU using standard industry practices for hoisting and rigging. A vibratory hammer well known in the art is used to sink the casing (8) into the ground to depth of approximately 22 feet. This depth is approximately 5 feet below the bottom of the VPU. The casing (8) is 25 feet long and therefore approximately 3 feet remains above the ground level. The 3 feet extension is intentional and will provide a safety buffer during the subsequent stabilization operation.

The next step in the process is to stabilize the contents of the VPU within the 4 feet diameter casing. In one aspect the IE (24) is attached on top of the EB (18). The rotational shaft (Kelly bar) (49) of the drilling rig (48) is attached to the auger shaft that protrudes through the top of the ATE (26) that is installed over the IE (24). The three part enclosure system is now ready for the stabilization operation. It is possible to combine the auger tool enclosure and the interface enclosure into one enclosure that has the same functionality as the two enclosures as shown in FIG. 8.

The drilling rig (48) starts rotating the augering tool (40) within the ATE (26) and lowers it through the IE (24) and EB (18) continuing down through the soil (6) and shredding the wall of the VPU (10). This operation continues for six to ten hours; grinding the VPU contents and mixing it with the surrounding soil in the casing (8). During the grinding process low pressure, low volume dust suppression system (Dust Bond™, calcium chloride solution) is used through the attachment port (39) to reduce dust during augering. The grinding of the VPU (10) exposes the chemicals that have been stored in cans and vials inside the VPU (10) allowing chemical reactions to occur including the NaK reactions. These chemicals react violently with each other in the presence of oxygen or water and are rendered less harmful after they are allowed to react. The mixing with the soil allows the free liquids to be absorbed and the soil chemical mixture is thoroughly mixed together. The process is completely and safely contained within the casing (8) that surrounds the augering tool (40). After about six to ten hours the stabilized mixture (9) is uniform having irregular shaped particles in a size range between approximately 0.5" and 3.0 inches. The stabilization process takes place under the ground and within the sealed structure formed by the casing (8), EB (18), IE (24) and ATE (26) eliminating the risk of contaminated waste reaching the surface. Air is continuously exhausted through HEPA filters (not shown) prior to being exhausted into the atmosphere. Port (30) is used for air sampling as necessary.

The next step is to lift the augering tool (40) using the drilling rig and bring it into the original position in the ATE (26). High pressure, low volume water jet is introduced through the port (38) to wash the soil mixture off the augering tool (40). This cleaning is done during the lifting of the augering tool (40) by the drilling rig (48). Multiple levels of high pressure, low volume jets are used. Even after thorough washing there may still be some soil residue stuck on the augering tool. A port (46) is provided to insert a swab material such as filter paper to take a smear sample to test for radio isotopes. If the test shows higher levels than are permitted by current standards then the washing is continued until the smear test shows acceptable contamination levels. The next step is to use the drilling rig (48) to remove the ATE (26) after shutting the door (28) to isolate it from the IE (24) unit. As explained earlier, the ATE (26). The IE (24) and the EB (18) may be combined into one unit and provided with the same functionality as the separate units have.

After the ATE (26) containing the augering tool (40) is removed from the IE (24) unit a spare ATE (26) containing the HSA (42) unit is attached to the IE (24) and the rotational shaft of the Kelly bar (49) is attached to the HSA (42) such that it can be lowered into the over casing that contains the stabilized mixture of soil and VPU contents (9). The HSA (42) has a hollow stem opening approximately 4 inches in diameter in which a gamma and neutron detector is inserted to measure the gamma and neutron emissions of the mixture. This in situ method allows for the classification of the waste as hazardous or non hazardous depending on the level of radioactivity detected. If the waste is considered hazardous because it exceeds the permitted radioactivity level it is classified as TRU waste when the radioactivity>100 nCi/gm. After the test results are obtained the probe assembly (52) is removed from the HSA (42) using a cable attached to a mechanical device such as a pulley mechanism. Instead of using the in-situ detector it is possible to test a sample of the stabilized mixture in another location such as in the RE (54) using a similar device or conducting the test in an outside laboratory.

If the stabilized mixture (9) is determined to be TRU then the next step is the determination if dust control additives are required to reduce dusting during removal of the contents. For waste with excessive dust a fixative grout is introduced through the hollow stem of the HSA (42) and mixed with the stabilized contents for approximately one to two hours. This step is not necessary if it is determined that the mixture is not dusty and can be removed without a dust control additive.

The drilling rig (48) is used to lift the HSA (42) into the ATE (26). The ATE (42) and IE (24) are then removed as one unit using the drilling rig (48). The next step is to place the RE (54) on top of the EB (18) as shown in FIG. 6. The RE (54) operates under a negative pressure (0.25 WG) to ensure that none of the air is leaked to the atmosphere. The technology for providing negative pressure is well known in the art and is not being described herein. The retrieval bucket (56) is attached to the drilling rig (48) and lowered into the casing (8) to scoop out the stabilized contents. Other devices such as screw conveyors can be used for this purpose. The retrieval bucket (56) has doors that are closed after the contents waste has been collected and the doors are provided with a release mechanism that discharges the contents into the hopper (58), which is placed on rails and can be laterally moved to provide access for the lowering and lifting of the retrieval bucket (56). The hopper (58) is provided with an outlet gate (64) through which the stabilized mixture that is retrieved from the casing (8) is discharged on to a conveyor belt (62). A video recording of the contents can be made for recording purposes using CCTV cameras (not shown) mounted within the RE (54) before the contents are loaded into new 55 gallon drums (60) for disposal as per applicable state regulations.

If after testing it is determined that the stabilized mixture of waste and soil is not TRU then grout mixture (64) is pumped from a cement truck through the stem (44) of the HSA (42) through openings (not shown) provided at the bottom of the HSA (42) to completely fill the casing (8). FIG. 6 shows the grout mixture (64) exiting from the bottom of the HSA (42) that is rotating as the grout mixture is pumped into the casing (8). The HSA (42) is retracted before the grout sets up into the ATE (26) and the ATE (26) and IE (24) are removed from the top of the EB (18). Typically the grout will tend to set up within 12 or so hours to form a monolith. This monolith is excavated using excavating machinery well known in the art. The monolith is removed and buried horizontally into trenches that have been dug at the site. The trenches are covered with soil.

CONCLUSION, RAMIFICATIONS, AND SCOPE

Thus the reader will see that at least one embodiment provides a system and method to remediate, analyze and safely remove waste in buried containers. While the above description contains much specificity, these should not be construed as limitations on the scope, but rather as an exemplification of other possible embodiments thereof.

For example:

The enclosure base can be eliminated and other guiding devices can be used. A positioning device attached to the casing could serve the same purpose as the enclosure base that is used to center and position the interface enclosure and the retrieval enclosure over the casing.

(ii) The augering tool enclosure and the interface enclosure can be combined into one unit and provided with the same functionalities as the two separate units.

(iii) Inserting the casing into the soil around the buried VPU can be done by means other than the use of a vibratory hammer. Diesel; air or pneumatic pile drivers may be used instead of the vibratory hammer.

(iv) The casing may be made of a metal other than steel and may have non-circular cross-section such as a rectangular cross-section.

(v) Instead of the drilling rig other systems such as a crane can be used to move the ATE and augering tool within it into position over the IE. The crane can provide augering action of rotation and up and down motion similar to a drilling rig.

(vi) Instead of the auger as the grinding tool other mechanical or non-mechanical (sonic) devices could be used to puncture the VPU and mix the contents with the soil.

(vii) The non destructive assay (NDA) can be done in an external laboratory using commercially available testing instruments to test for radioactivity and the TRU status of the waste.

(viii) Treatment methods during grinding can be grout free or use various compositions of grouting media such as bentonite to modify the rheology or fluidity of the grout. Grout can be introduced by various means instead of using the hollow stem auger as the path described above.

(ix) There are other retrieval options. Instead of the bucket system described in the embodiments above, one can use an excavator with clam shell to retrieve the mixture. Other retrieval methods such as a vertical screw conveyor or pneumatic transfer can be used for mixture retrieval.

(x) For certain types of non TRU waste it may be possible to use a conventional excavator to remove the VPU's along with the surrounding soil with or without grinding the VPU contents and mixing them with the soil.

(xi) Other drilling technologies such as sonic drilling have been used in the industry.

What is claimed is:

1. A method for safe removal of buried waste comprising:

a) enclosing the buried waste in a casing;

b) providing a system for grinding and mixing the buried waste with surrounding soil to form a mixture c) permitting chemical reactions to occur during mixing to stabilize the mixture;

d) testing the mixture for radio isotopes and e) providing a retrieval mechanism for removal of the buried waste whereby the mixture is stabilized underground without the possibility of surface contamination, tested and safely removed for disposal.

2. The method of claim 1 wherein an enclosure base is used for centering the casing over the buried waste.

3. The method of claim 1 wherein the casing is mechanically driven to enclose the buried waste.

4. The method of claim 1 wherein the grinding mechanism is a rotating augering tool that is housed in an augering tool enclosure concentrically fitted over the casing via an interface enclosure that is fitted over the enclosure base.

5. The method of claim 1 wherein the rotating motion of the augering tool is provided by a drilling rig.

6. The method of claim 1 wherein dust is controlled by using dust control chemicals inserted through one or more openings provided in the interface enclosure.

7. The method of claim 1 wherein the augering tool is cleaned prior to removal by using high pressure water through openings provided in the interface enclosure.

8. The method of claim 1 wherein testing the mixture is done by inserting a detector through a hollow stem auger.

9. The method of claim 8 wherein the detector tests for the presence of radio isotopes in the mixture in situ as the hollow stem auger is rotating in the mixture.

10. The method of claim 9 wherein test results are remotely monitored for classification as transuranic or not transuranic waste.

11. The method of claim 1 wherein a retrieval enclosure is mounted over the enclosure base.

12. The method of claim 1 wherein the retrieval mechanism for transuranic waste is provided by a retrieval bucket attached that scoops out the mixture and removes it into the retrieval enclosure for safe disposal.

13. The method of claim 12 wherein the retrieval bucket is moved axially into the casing by the drilling rig.

14. The method of claim 12 where in the retrieval enclosure contains a hopper and conveyor to transport the mixture into drums for disposal.

15. The method of claim 10 wherein grout is injected through the hollow stem auger for waste that is not transuranic.

16. The method of claim 15 wherein the hollow stem auger is removed by the drilling rig and the grout allowed to cure with the mixture to form a monolith.

* * * * *